United States Patent [19]

Rogister

[11] Patent Number: 4,509,317

[45] Date of Patent: Apr. 9, 1985

[54] APPARATUS AND METHOD FOR MAKING METALLIC CORD

[75] Inventor: Carl Rogister, Colmar-Berg, Luxembourg

[73] Assignee: The Goodyear Tire & Rubber Company, Akron, Ohio

[21] Appl. No.: 488,492

[22] Filed: Apr. 25, 1983

[30] Foreign Application Priority Data

May 7, 1982 [LU] Luxembourg ..... 84135

[51] Int. Cl.[3] ..... D07B 3/12; D07B 3/02

[52] U.S. Cl. ..... 57/58.32; 57/58.3; 57/58.36

[58] Field of Search ..... 57/3, 6, 58.3, 58.32, 57/58.36, 58.52, 58.57, 58.59, 58.63, 58.83, 58.86, 58.54, 58.55, 58.7, 311

[56] References Cited

U.S. PATENT DOCUMENTS

| | | | |
|---|---|---|---|
| 2,010,888 | 8/1935 | Pool | 57/58.32 |
| 2,567,329 | 9/1951 | Frazier | 57/58.34 |
| 2,921,428 | 1/1960 | Lütcke | 57/58.3 |
| 2,998,694 | 9/1961 | Haugwitz | 57/58.52 |
| 3,058,681 | 10/1962 | Clarkson | 57/58.3 |
| 3,902,307 | 9/1975 | Shoerner | 57/58.3 X |
| 4,030,248 | 6/1977 | Van Assendelft | 57/902 X |
| 4,335,571 | 6/1982 | Tarantola | 57/58.52 |

FOREIGN PATENT DOCUMENTS

| | | | |
|---|---|---|---|
| 3014190 | 10/1980 | Fed. Rep. of Germany . | |
| 58542 | 5/1976 | Japan | 57/58.57 |
| 8102273 | 5/1981 | Netherlands . | |

*Primary Examiner*—Donald Watkins

*Attorney, Agent, or Firm*—T. P. Lewandowski

[57] ABSTRACT

Apparatus and method for making metallic cords to be used as reinforcing members in elastomeric structures using a skip strander and a false twist principle to join together two elements comprising filaments or strands parallel in at least one element and further maintaining separate tension levels on the two elements to provide a cord which is uniform in the helixes which are formed by joining the two elements together.

28 Claims, 6 Drawing Figures

APPARATUS AND METHOD FOR MAKING METALLIC CORD

The present invention relates to a method and apparatus for stranding together metal wires, either individual separate wires referred to herein as filaments or strands of a plurality of filaments, to produce metallic cord. The method and apparatus are particularly well adapted for making metallic cord to be used for reinforcing elastomeric articles such as tires, conveyor belts, and alike.

It is well known to use steel wire for the production of metallic cord, and in the present description such an elementary wire will be referred to as a filament but it should be understood that the invention would not be limited to steel wire. Several filaments may be stranded together in a helical or non-helical arrangement to form a strand and these strands in turn may be stranded or twisted together in a helical arrangement to form a cord suitable for reinforcing one of the above articles.

Cords of the above-type construction are referred to as coreless in distinguishing them from those which are formed by filaments wound about a rectilinear central element, such as a filament or a strand, which is of a fixed core type.

It is known to produce coreless wire such as $4\times0.25$ on a 2 for 1 "twisting" type machine, commonly known as a stranding machine, having four internal spools feeding four filaments of 0.25 mm wire out of the inside of a machine over a rotating flyer and back into the machine to obtain two twists or turns on the filaments for every revolution of the flyer to produce a cord having four filaments twisted together.

Stranding machines are also known for making the above type twisted cord which are limited to a single path operation which gives half the production of the two for one type process described above. Such stranding machines only produce a twisted strand structure since they are twisting machines and not the two element type cord of the present invention and more particularly not a multifilament strand without twist as will be disclosed herein.

Further single path stranding machines are known which have pre-forming equipment added thereto resulting in their being able to make the two element type cord. The pre-forming equipment however requires additional capital and maintenance and is more complicated than the conventional single path stranding machine.

The present method and apparatus overcome the above problems by providing individual tension control of the two elements of the cord while eliminating the need for pre-forming and devising a way to form two element cord on a single path operation stranding machine using a mechanical set as for example a false twist step as part of the method to obtain untwisted filaments in at least one strand of the cord construction.

The present invention has the advantages of eliminating the need for pre-forming equipment along with its attendant additional capital cost and maintenance requirements as well as additional floor area to accomodate the equipment.

Control of tension on the individual elements in the cord provides for a more uniform cord construction. The tension control further gives better control of back twist in the machine to also further enhance the uniform final construction of the cord. The final product retains the advantages of cord openness for rubber penetration and thereby the advantage of increased resistance to corrosion upon cut penetration of the elastomer surrounding the cord. The method and apparatus have permitted longer lay lengths with fewer turns per length over that produced by other single path operation stranding machines to reduce the speed of rotation of the present machine to less than twice that of the two for one strander when production from the two machines is equal.

The above advantages, and others that may be understood from the following descriptive disclosures of the present invention, are accomplished by providing a method for producing metallic cords adapted to be used as reinforcing members in elastomer structures having a first element of two or more parallel filaments brought together with a second element of one or more filaments, the method comprising the steps of: withdrawing a first group of filaments at a pre-determined tension from a plurality of fixedly located delivery spools and applying a turn to the first group of filaments forming the first element; withdrawing one or more filaments forming a second element at a predetermined tension from one or more fixedly located delivery spools; directing the second element along an axis of rotation on which the turn is applied; bringing the first and second elements together while maintaining the predetermined tensions respectively thereon to helically form one element with respect to the other by application of the turn on the first element, formed of the first group of filaments, to the second element, formed of one or more filaments, which second filament has received no turns because of its location on the axis of rotation; and subsequently mechanically setting the cord formed above to set the cord structure formed by joining the two elements together.

The present invention further provides an apparatus for producing metallic cords adapted to be used as reinforcing members in elastomeric structures in a machine comprising: a flyer mounted to be rotatable about its axis by drive means therefor; a shuttle mounted within the flyer and freely rotatable relative thereto to permit it to remain non-rotatable while the flyer rotates about its axis; hollow bearings in the flyer and shuttle whereby a filament or filaments may pass from the interior of the shuttle to the exterior of the flyer and vice versa; means for drawing filaments from spools and through the machine to form cord; means for guiding filaments into one end of the flyer, over its exterior and out the other end of the flyer and through the shuttle and out an end thereof in a path coinciding with the axis of rotation; and means for controlling tension on at least two separate groups of filaments at predetermined limits prior to their joining together to form a cord.

The above features and advantages will be apparent upon reading the following description with reference to the accompanying drawings wherein.

Figure 1:
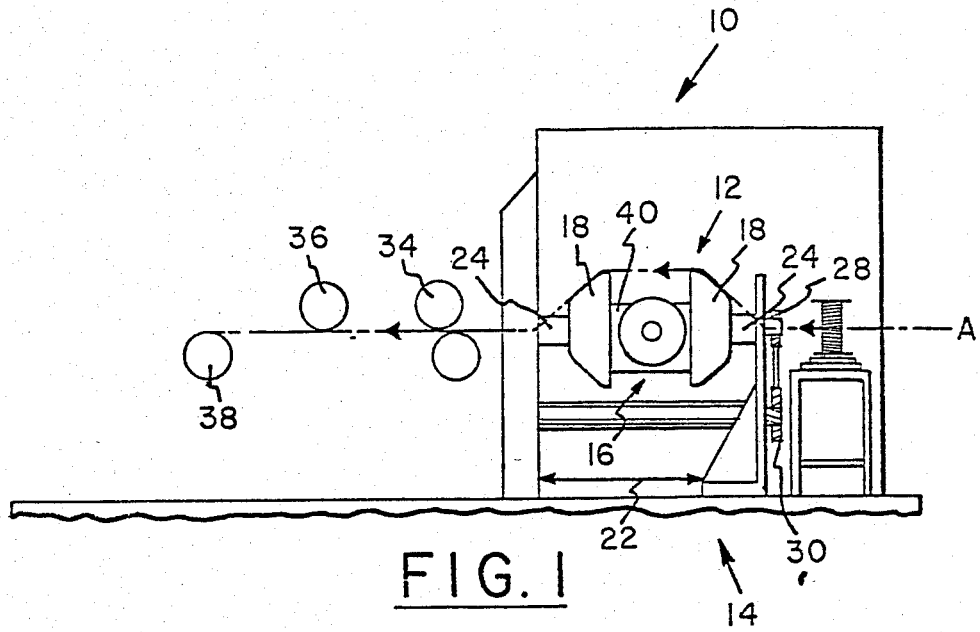
FIG. 1 is a diagrammatic illustration of the machine according to the invention with parts therefore depicted by symbols.

Referring to FIG. 1, a machine 10 is disclosed having a flyer 12 supported by a base 14 to rotate the flyer 12 about its own horizontal axis denoted by the letter "A". A shuttle 16 is mounted co-axially inside the flyer 12 and rotates freely with respect to it making it fixed relative to the rotating flyer 12.

Figure 3:
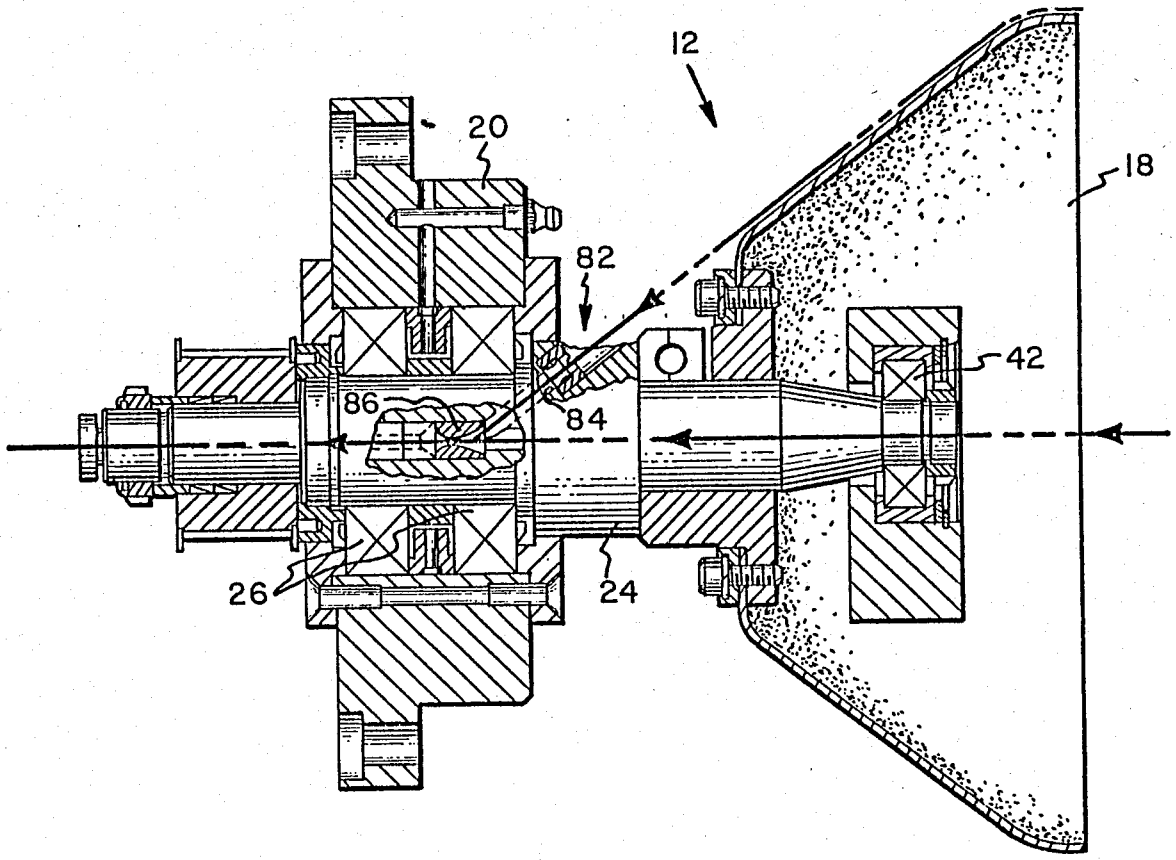
FIG. 3 is an enlarged view of a portion of the flyer in FIG. 2 with parts broken away to show more detail.

The rotating flyer 12 has two cones 18 co-axially disposed and spaced apart but fixed with respect to one another. As best illustrated in FIG. 3 each cone 18 is rotatably supported by a hollow hub 20 fixed with respect to a frame 22 disposed axially outside the flyer 12 which in turn is fixed with respect to a flyer shaft 24 which is also hollow, co-axial to, and rotates in the hub 20.

Each flyer shaft 24 is mounted in a corresponding support of the base 14 through rotating means such as roller bearings or ball bearings 26, illustrated, or any other arrangement that allows free rotation of the shaft 24.

The flyer shaft 24 has a drive member such as a sprocket or pulley 28, illustrated, driven by a chain or belt respectively, which drive member is co-axially affixed to it. The belt or chain then is driven by a corresponding drive pulley 30, illustrated, or sprocket co-axially affixed to a drive shaft 32 rotatably supported by the base 14 and driven by a motor (not illustrated) which is usually housed within a unit supporting a tensioning unit, twist setting unit and their capstans to drive these units in a synchronized manner. The twist setting and tensioning unit capstans 34 and 36 are symbolically illustrated in FIG. 1.

Also symbolically illustrated in FIG. 1 is a takeup spool 38 for storing the cord made on the machine 10 by winding it thereon.

The flyer shafts 24 extend within the cones 18 of the flyer 12 and serve as a support for the shuttle 16 which has a framework 40 supported by rotatable means, such as bushings or the bearings 42, illustrated, mounted on and co-axial with the flyer shafts 24 which provide free rotation to the shuttle 16.

Figure 2:
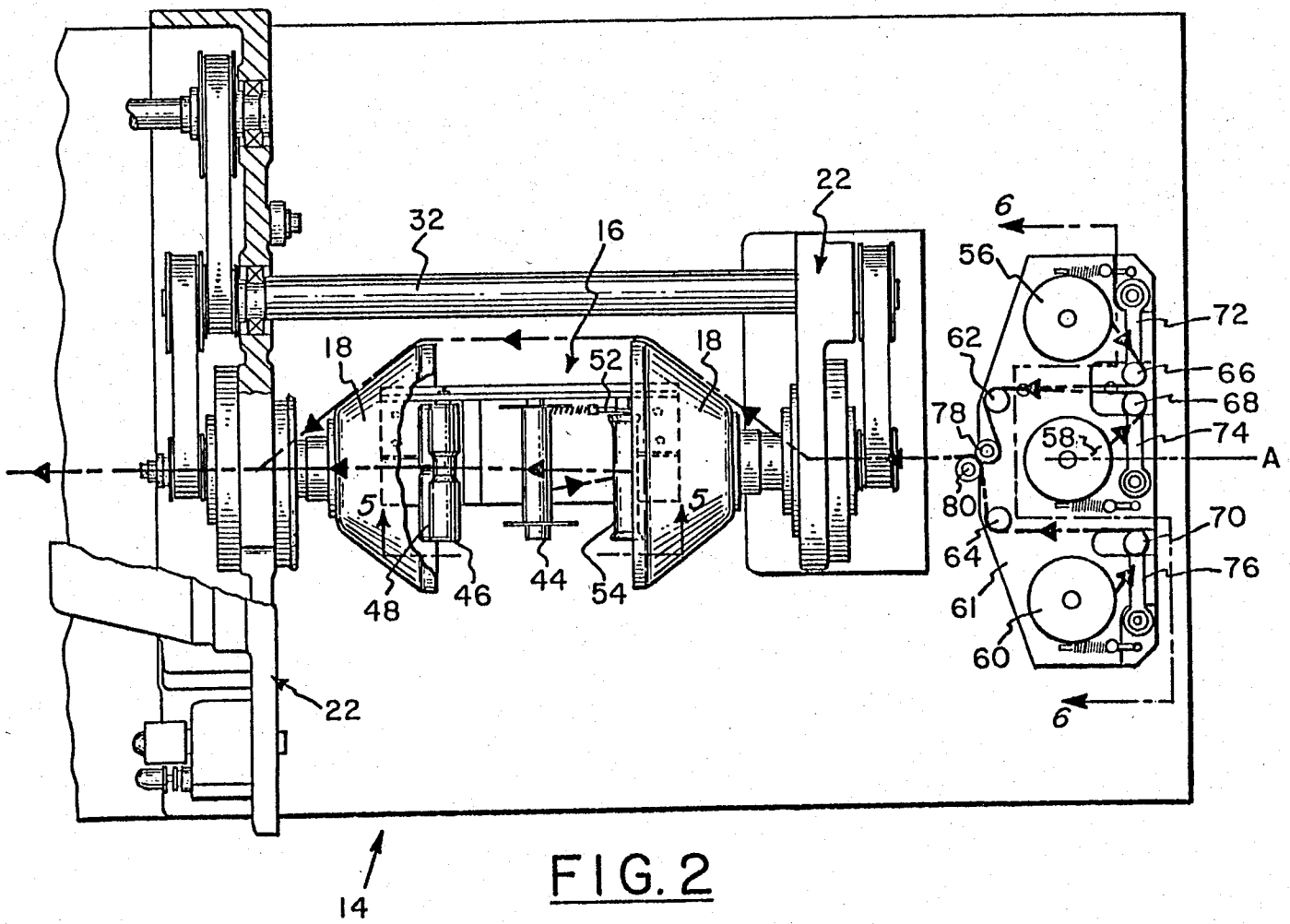
FIG. 2 is a view of the machine taken along lines 2—2 of FIG. 1.
Figure 5:
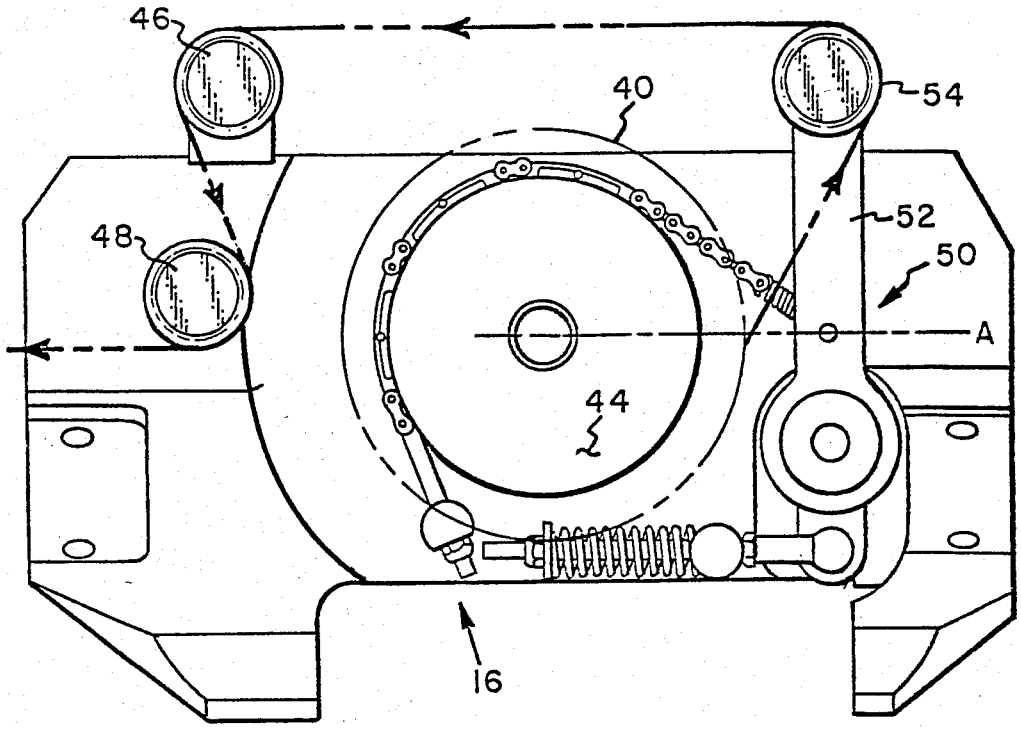
FIG. 5 is a view along line 5—5 of FIG. 2 with the spools depicted in phantom to show more detail.
Figure 6:
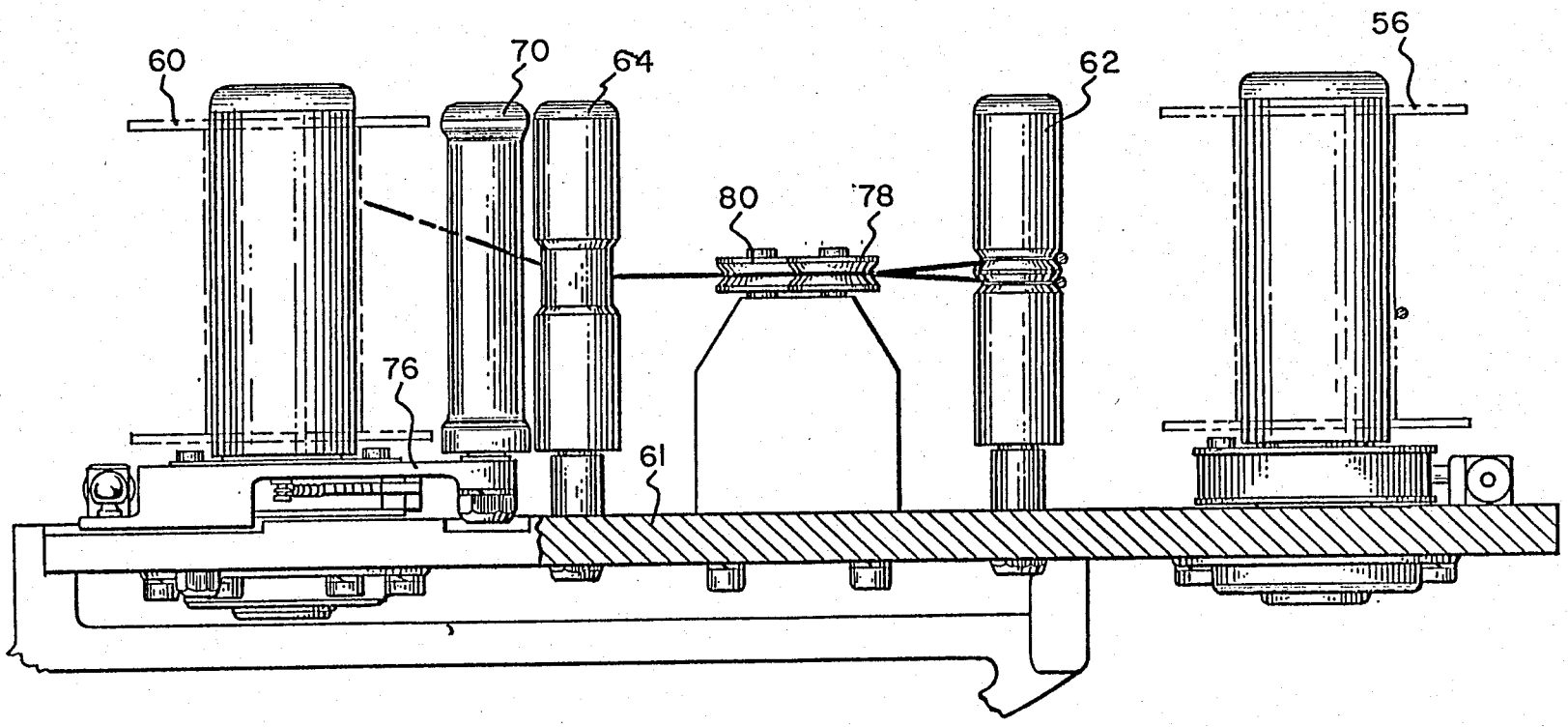
FIG. 6 is a cross section taken along line 6—6 of FIG. 2.

As best illustrated with FIGS. 2 and 5, the shuttle 16 supports an internal spool 44 of wire, idler pulleys 46 and 48 and brake means preferably an active brake 50, as illustrated, all of which have their axis of rotation perpendicular to that of the flyer axis "A". Examples of other braking means which can be used with filament spools are adjustable drag brakes or even separate brake capstans. The idler pulleys 46 and 48 are free to rotate about their axes while the spool 44 has the active brake 50 to prevent the spool 44 from overriding the filament being let off the spool 44 and to further control tension in the individual filament.

The active brake 50 for the spool 44 is able to sense through pivoting of the spring biased brake arm 52 any change in tension on the filament wrapping the guide idler post 54 on the arm 52. This movement of the brake arm 52 provides adjustment to the brake 50 to maintain a predetermined tension on the filament.

FIG. 2 illustrates three external filament spools 56, 58 and 60 mounted on a support 61 in a manner similar to that described for the spool 44 mounted on the shuttle 16 inside the flyer 12. The filament being fed from the three spools 56–60 is directed across idler pulleys 62, 64 after the filaments from each spool 56–60 have been gathered by passing them over guide idler posts, 66, 68 and 70 mounted on brake arms 72, 74 and 76 and then passing the filaments over idler pulleys 78 and 80. The gathered filaments then pass from the idler pulleys 78 and 80 into the center of the flyer shaft 24 from where the filament is directed up over the flyer cones 18 and back down into the flyer shaft 24 on the other side of the shuttle 16. At the same time a single filament is drawn from the internal spool 44 on the shuttle 16 and passed around the guide idler post 54 mounted on the brake arm 52 and then over the idler pulleys 46 and 48 as best illustrated in FIG. 5 and onto the flyer shaft 24 through which it passes to join the three filaments which have been passed over the flyer 12 and brought back into the shaft 24 as best illustrated in FIG. 3.

It can be appreciated that the single filament from the internal spool 44 on the shuttle 16 being on the axis of rotation "A" does not rotate about its axis and therefore receives no turns. On the other hand the three filaments passing over the outside of the flyer 12 are rotated by the flyer 12 together to receive one turn for each revolution of the flyer 12.

An opening 82 in the flyer shaft 24 is connected to the hollow center of the shaft 24 by a passage such as an angular passage 84 which intersects the rotational axis "A" of the flyer shaft 24 immediately in front of an exit die 86 mounted within the hollow flyer shaft 24 and concentric with its axis of rotation "A". In the embodiment illustrated, the angular passage 84 makes an angle of approximately 35° with the axis of rotation "A" which is the preferred angle for the filament but a range of 10° to 75° is considered operable for this angle even though the one illustrated is preferred. Due to the angle between the single filament and the three filaments that are rotating about it and the threading of the three filaments together they act as a single element to be helically formed with a second element, formed by the single filament, one with respect to the other. The tension on each of the three filaments is set below that for the single filament since they act in concert. When the two elements helically form together they form a cord with elements which have the same helixes which cord is passed out of the flyer 12.

What has been described above is apparatus to produce metallic cords adapted to be used as reinforcing members in elastomeric structures in a machine 10 and particularly fixedly located external filament spools 56–60 mounted on their support 61 which is on the base 14 external to the flyer 12. A single filament is fed from each spool 56–60 across the guide idler posts 66–70 rotatably mounted on respective brake arms 72–76 which pivot to maintain a predetermined tension on the filament. The three filaments are guided by the idler pulleys 62, 64 being wound thereabout to direct the filaments in turn to the idler pulleys 78 and 80. The idler pulleys 78 and 80 are tangent to the rotational axis "A" of the flyer 12 and thus direct the three filaments into the hollow portion of the flyer shaft 24. The active brakes mounted on the support 61 and applied individually to each of the spools 56–60 which are external to the flyer 12 provide means for maintaining the equal tension on all three filaments to allow them to act as one element in passing through the machine 10. Upon entering the hollow portion of the flyer shaft 24 the three filaments pass an entry die (not illustrated but the same as the exit die 86 in FIG. 3) and then are directed through the angular passage, the same as angular passage 84 of FIG. 3 in the flyer shaft 24 to its like entry opening whereby the three filaments are directed around the outside of the flyer 12 in a path closely following the surface of the flyer cones 18. Thus the three filaments are offset around the internal spool 44 and shuttle 16. These three filaments are returned to the center of the flyer shaft 24 through an opening 82 in front of the angular passage 84 connecting the opening 82 with the exit die 86 which brings the three filaments into coincidence with the rotational axis "A" of the flyer 12 to join the single filament being directed from the internal spool 44 to the exit die 86. The exit die 86 is coaxial with the flyer shaft 24 and the opening 82 is on the surface of the flyer shaft 24. The single filament offset by its guide idler post 54 mounted on the active brake arm 52 and the idler pulleys 46 and 48, is brought back into concidence with the axis "A" of the flyer 12 by the location of the idler pulley 48 tangent to the axis "A". The single filament passes onto the exit die 86 where all four wires are coincident with the axis of the flyer 12 as they pass the point of intersection between the three filaments and a single filament. Prior to the joining of the two elements an angle is maintained between them with the second element being maintained generally on the axis of rotation "A".

It will be appreciated that the internal spool 44 and the single filament thereon could be mounted external to the flyer 12 and passed through the center of the flyer entry die and on through to the exit die 86, being maintained on the axis of rotation of the flyer 12 to accomplish the process described above. Further, different wire cord constructions can be made by using two filaments in place of the three filaments in the above apparatus and by adding filaments to the internal spool 44 or alternately adding an additional spool outside the flyer 12 to the one described above for passing straight through the machine 10 on its rotational axis.

Returning to the exit die 86 in FIG. 3, at this point as the single filament and the three filaments come together they are treated as separate elements or two individual strands.

The element which consists of the three filaments upon receiving a turn from one revolution of the flyer 12 causes the element to be further joined with the element formed by the single filament coming off of the internal spool, one to the other with helices of equal pitch. It should be noted at this point that while the three filaments receive a turn per revolution of the flyer 12 the single filament being on the axis of rotation "A" of the flyer 12 and maintained free of contact with it has no turns applied to it. However due to the angle of approach of the element consisting of the three filaments to the element consisting of the single filament the relative motion between the two elements results in the above common helix and pitch angles as the two elements are joined together. The formed cord passes through the flyer shaft 24 of the flyer 12 (see FIG. 1) and on to a false twist mechanism which in the preferred embodiment is a twist setting unit 34 illustrated symbolically as two rollers about which the formed cord makes a figure eight configuration to overtwist the cord thereby setting its configuration and then removing the overtwist before passing on to the tensioning unit capstan 38 which supplies the pull through force for the machine 10. The cord then passes on to a wind-up spool 38, both the wind-up spool 38 and tensioning unit capstan 36 also being symbolically illustrated in FIG. 1.

The tensioning unit for the tensioning unit capstan 36 is conventional and well-known to those skilled in the art as is the drive for the wind-up spool 38, neither of which are therefore further described or illustrated herein.

Figure 4:
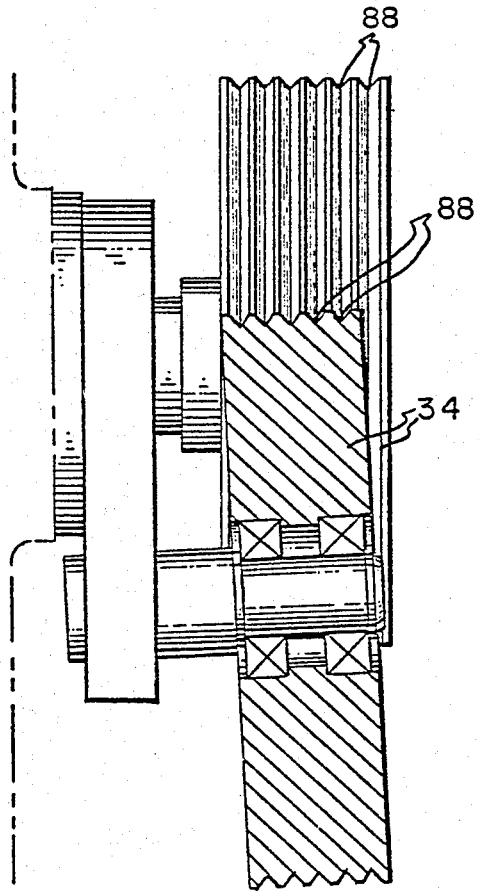
FIG. 4 is a detailed figure of the twist setting unit capstan of FIG. 1.

The twist setting unit capstan 34 is shown in further detail in FIG. 4 (illustrated without the cord for clarity) wherein it can be seen that its surface has grooves for receiving the formed cord. It was found that in wrapping the capstan 34 with a cord formed by the new method it was advantageous to separate the cord with the grooves, while the cord was under high tension of the twist setting unit to avoid cord entanglement.

Referring to FIGS. 2, 3, 5 and 6 it was found advantageous to place active brakes 50 on all the spools 44, 56, 58, 60 to control tension on the elements defined by the three filaments passing over the flyer 12 and the single filament being paid off of the internal spool 44. As mentioned above the active brake 50 provides a controlled tension on the individual filaments to thereby give like control on individual elements. It was found in practice that a ratio of the tension of each of the three filaments to the tension of the single filament of 1.6 worked best. It was further found that if the tension levels were reversed with a high enough tension being placed on the three filament element and a lower tension on the single filament element the single filament would simply form a wrap around the three filaments which remained a straight core element and no common helices were formed between the two elements. On the other hand, if too high a tension could be maintained on the single filament the three filaments would simply form a wrap around the single filament which would remain straight.

It was found that the above-described cord had a uniform lay length. At a lay length of 14 millimeters which was an increase over the previous 12 or 12½ millimeter layer length, there resulted an increase in output from the machine since for the longer lay length fewer turns per length of wire need to be introduced to achieve a final cord structure.

The method as well as the principal and mode of operation of the machine have been explained and what is considered to represent its best embodiment has been illustrated and described. It should, however, be understood that the invention may be practiced otherwise than as specifically illustrated and described without departing from its spirit or scope.

I claim:

1. A method for producing metallic cords adapted to be used as reinforcing members in elastomer structures having a first element of two or more parallel filaments brought together with a second element of one or more filaments, the method comprising the steps of:

withdrawing a first group of filaments at a pre-determined tension from the plurality of fixedly located delivery spools and applying a turn through the first group of filaments forming the first element;

withdrawing one or more filaments forming a second element at a predetermined tension from one or more fixedly located delivery spools;

directing the second element along an axis of rotation on which the turn is applied;

bringing the first and second elements together while maintaining the predetermined tensions respectively thereon to helically form one element with respect to the other by application of the turn on the first element, formed of the first group of filaments, to the second element, formed of one or more filaments, which second element has received no turns because of its location on the axis of rotation; and subsequently mechanically setting the cord formed above to set the cord structure formed by joining the two elements together.

2. The method defined in claim 1 wherein the second element is maintained free of any turns being applied to the first element.

3. The method defined in claims 1 or 2 wherein the first and second elements are brought together at about the axis of rotation.

4. The method defined in claims 1 or 2 wherein said first element is formed by withdrawing three filaments one each from three fixedly located external delivery spools.

5. The method defined in claims 1 or 2 wherein said second element is formed by withdrawing a single filament from a single fixedly located internal delivery spool.

6. The method defined in claims 1 or 2 wherein the tension on said second element is greater than the tension on said first element.

7. The method defined by claims 1 or 2 wherein the ratio of the tension on said first element to the tension on said second element is about 1.6.

8. The method defined in claims 1 or 2 wherein the first and second elements are brought together at an angle between 10° and 75°.

9. The method defined in claims 1 or 2 wherein the first and second elements are brought together at an angle of approximately 35°.

10. The method of producing metallic cords adapted to be used as reinforcing members in elastomeric structures on a strander having the capability of introducing turns into a group of filaments passing over a flyer for each revolution of the flyer without twisting the group of filaments together, the method comprising the steps of:

withdrawing three filaments from three separate fixedly located external spools to pass them into the strander flyer and then out around the flyer applying a turn to the three filaments;

withdrawing a single filament from a fixedly located delivery spool internal to the flyer;

bringing the first three filaments together with the single filament by bringing the three filaments back into the flyer; and maintaining angularity between the three filaments and the single filament as they are brought together to form a cord with the first three filaments generally parallel to each other and the single filament helically formed therewith into a final structure.

11. Apparatus for producing metallic cords adapted to be used as reinforcing members in elastomeric structures in a machine comprising:

a flyer mounted to be rotatable about its axis by drive means therefor;

a shuttle mounted within the flyer and freely rotatable relative thereto to permit it to remain non-rotatable while the flyer rotates about its axis;

hollow bearings in the flyer and shuttle whereby a filament or filaments may pass from the interior of the shuttle to the exterior of the flyer and vice versa;

means for drawing filaments from spools and through the machine to form cord;

means for guiding filament into one end of the flyer over its exterior and out the other end of the flyer and through the shuttle and out an end thereof in a path coinciding with the axis of rotation; and means for controlling tension on at least two separate groups of filaments at predetermined limits prior to their joining together to form a cord.

12. The apparatus defined in claim 11 including means for maintaining angularity between the separate groups of filaments at the point they are joined together to form a cord.

13. The apparatus defined in claim 11 wherein the means for controlling tension further includes means for applying a braking force on some of the filaments at a level different from that of the other of the filaments.

14. The apparatus defined in claim 13 wherein said means for applying a braking force further includes active brakes on the spools supplying the filaments.

15. The apparatus defined in any one of claims 12 to 14 wherein the means for maintaining angularity include a flyer passageway.

16. The apparatus defined in claims 11, 12 or 14 wherein said guiding means include an exit die.

17. The apparatus defined in claims 11, 12 or 14 wherein said guiding means include an entry die.

18. The apparatus defined in claims 11, 12 or 14 wherein said means for controlling tension includes a grooved tension unit brake capstan.

19. The method defined in claim 3 wherein said first element is formed by withdrawing three filaments one each from three fixedly located external delivery spools.

20. The method defined in claim 19 wherein said second element is formed by withdrawing a single filament from a single fixedly located internal delivery spool.

21. The method defined in claim 20 wherein the tension on said second element is greater than the tension on said first element.

22. The method defined by claim 21 wherein the ratio of the tension on said first element to the tension on said second element is about 1.6.

23. The method defined in claim 22 wherein the first and second elements are brought together at an angle between 10° and 75°.

24. The method defined in claim 22 wherein the first and second elements are brought together at an angle of approximately 35°.

25. The apparatus defined in claim 13 wherein the means for maintaining angularity include a flyer passageway.

26. The apparatus defined in claim 25 wherein said guiding means include an exit die.

27. The apparatus defined in claim 26 said guiding means include an entry die.

28. The apparatus defined in claim 27 wherein said means for controlling tension includes a grooved tension unit brake capstan.

* * * * *